US010636406B2

(12) United States Patent
Fink

(10) Patent No.: US 10,636,406 B2
(45) Date of Patent: Apr. 28, 2020

(54) AUTOMATED ROOM AUDIO EQUIPMENT MONITORING SYSTEM

(71) Applicant: Crestron Electronics, Inc., Rockleigh, NJ (US)

(72) Inventor: Dennis Fink, Warwick, NY (US)

(73) Assignee: Crestron Electronics, Inc., Rockleigh, NJ (US)

( * ) Notice: Subject to any disclaimer, the term of this patent is extended or adjusted under 35 U.S.C. 154(b) by 26 days.

(21) Appl. No.: 16/007,311

(22) Filed: Jun. 13, 2018

(65) Prior Publication Data

US 2018/0359583 A1 Dec. 13, 2018

Related U.S. Application Data

(60) Provisional application No. 62/518,870, filed on Jun. 13, 2017.

(51) Int. Cl.

| | |
|---|---|
| ***H04R 3/04*** | (2006.01) |
| ***H04R 29/00*** | (2006.01) |
| ***G10K 11/178*** | (2006.01) |
| ***H04S 7/00*** | (2006.01) |
| ***G10L 25/51*** | (2013.01) |

(52) U.S. Cl.

CPC .. *G10K 11/17823* (2018.01); *G10K 11/17853* (2018.01); *G10K 11/17855* (2018.01); *G10L 25/51* (2013.01); *H04R 3/04* (2013.01); *H04R 29/001* (2013.01); *H04S 7/305* (2013.01); *G10K 2210/108* (2013.01); *G10K 2210/3011* (2013.01); *G10K 2210/3028* (2013.01); *H04R 2430/01* (2013.01); *H04R 2430/03* (2013.01); *H04S 7/307* (2013.01)

(58) Field of Classification Search

CPC .... H04R 29/00; H04R 29/001; H04R 29/002; H04R 29/007; H04R 2430/01; H04R 3/04; H04R 3/12

USPC ..... 381/56, 58, 59, 96

See application file for complete search history.

(56) References Cited

U.S. PATENT DOCUMENTS

| | | | | |
|---|---|---|---|---|
| 5,572,443 A * | 11/1996 | Emoto | ..... | H03G 5/165 381/101 |
| 6,760,451 B1 * | 7/2004 | Craven | ..... | H03G 5/005 381/59 |
| 7,529,377 B2 * | 5/2009 | Nackvi | ..... | H04S 7/301 381/103 |

(Continued)

*Primary Examiner* — Xu Mei

(74) *Attorney, Agent, or Firm* — Crestron Electronics, Inc.

(57) ABSTRACT

A room monitoring System is provided, comprising: a speaker; a microphone; and a digital signal processor (DSP) adapted to generate and transmit a first audio test signal to the speaker to be broadcast in the room, wherein the first audio test signal comprises a power spectral density that is inversely proportional to its frequency, and wherein the transmitted first audio test signal is reflected within the room, and wherein the DSP is further adapted to process the reflected broadcast first audio test signal received by the microphone, generate and save a frequency-amplitude analysis of the received first audio test signal as an initial reference curve, periodically test the room in a substantially similar manner to generate one or more additional reference curves, and compare the one or more additional reference curves to determine whether they are within a known, predetermined tolerance of the initial reference curve.

13 Claims, 9 Drawing Sheets

(56) References Cited

U.S. PATENT DOCUMENTS

| | | | | |
|---|---|---|---|---|
| 7,769,184 | B2 * | 8/2010 | Kino | G01H 5/00 381/59 |
| 9,008,331 | B2 * | 4/2015 | Aggarwal | H04S 7/301 333/28 R |
| 9,137,619 | B2 * | 9/2015 | Nackvi | H04S 7/301 |
| 9,380,400 | B2 * | 6/2016 | Sprogis | H04R 5/027 |
| 9,609,449 | B1 * | 3/2017 | Maenpaa | G01D 1/18 |
| 2009/0274307 | A1 * | 11/2009 | Yoshino | H04S 7/301 381/1 |
| 2015/0023509 | A1 * | 1/2015 | Devantier | H04R 29/001 381/58 |

* cited by examiner

Before Use of ANCS 200

AUTOMATED ROOM AUDIO EQUIPMENT MONITORING SYSTEM

PRIORITY INFORMATION

The present application claims priority under 35 U.S.C. § 119(e) to U.S. Provisional Patent Application Ser. No. 62/518,870, filed 13 Jun. 2018, the entire contents of which are expressly incorporated herein by reference.

BACKGROUND OF THE INVENTION

Technical Field

The embodiments described herein relate generally to room monitoring systems, and more specifically to systems, methods, and modes for determining audio calibration specifications of a room utilizing a minimum amount of equipment.

Background Art

Currently available ambient noise sensor systems (ANSS) 100, as shown in FIG. 1, use both speaker 102 and microphone (mic) 104 to ascertain the noise level in acoustic space 114. Also shown in FIG. 1 as part of currently available noise sensor system 100 are ambient noise cancellation circuit (ANC) 110 (to determine noise levels and provide the output signal), combined digital-to-analog converter/amplifier (DAC) 106 (to convert the digitized audio output of ANC 110 to an analog signal and amplify the same), and combined analog-to-digital converter/pre-amplifier 108 (to receive the analog signal from mic 104, amplify it, and then convert the amplified analog signal to a digital signal). Speaker 102 broadcasts messages/announcements, and mic 104 can be used to measure the ambient noise. The ambient noise can be detected/measured just prior to when an announcement is to be played over speaker 102 and measured. Based on the measured amount of ambient noise, gain is then added to amplifier 106 by digital commands to increase the output of amplifier 106. For example, if the announcement was typically to be broadcast at 60 decibels (dB) sound pressure level (SPL), and it was determined that there is about 10 dB SPL noise level as measured by ANSS 100, then some gain, perhaps about 10 dB, can be added to the gain of amplifier 106 such that the output SPL is now set to be about 70 dB, instead of 60 dB; thus, a constant signal-to-noise ratio (SNR) is maintained. Such ANSS 100 involves multiple components; in relatively large rooms, or enterprise locations with a significant amount of rooms, the extra components can drive up the costs when implementing ANSS 100.

Accordingly, a need has arisen for systems, methods, and modes for determining ambient audio conditions utilizing a minimum amount of equipment.

As those of skill in the art can further appreciate, it is desirable to "tune" a room spectrally; that is, when using an audio system, to calibrate the amplifiers and mixers such that spectrally the response of the room is substantially flat. What is meant by "flat" is that there are neither significant valleys nor peaks in the spectral response of the room. All rooms, to some extent, will affect the frequencies of audio signals broadcast in the room in either a constructive manner, or destructive manner. That is, if a spectrally flat signal were input to the amplifier system, and a spectral response from the speakers were obtained, at some frequencies there would be valleys—meaning points of greater attenuation, and in other places there would be peaks, meaning points in which constructive interference had occurred.

Currently available audio calibration systems utilize separate spectrum analyzers and pink noise generators. As those of skill in the art can appreciate, pink noise or "1/f" noise is a signal or process with a frequency spectrum such that the power spectral density (energy or power per frequency interval) is inversely proportional to the frequency of the signal. In pink noise, each octave (halving/doubling in frequency) carries an equal amount of noise energy. The name arises from the pink appearance of visible light with this power spectrum. This is in contrast with white noise, which has equal intensity per frequency interval.

Currently available audio calibration systems utilize multiple devices including noise generators, spectrum analyzers and other devices.

SUMMARY

It is an object of the embodiments to substantially solve at least the problems and/or disadvantages discussed above, and to provide at least one or more of the advantages described below.

It is therefore a general aspect of the embodiments to provide systems, methods, and modes for determining ambient audio conditions utilizing a minimum amount of equipment that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

According to a first aspect of the embodiments, a room audio equipment monitoring System (RMS) is provided, comprising: a speaker; a microphone; and a digital signal processor (DSP) adapted to generate and transmit a first audio test signal to the speaker to be broadcast in the room, wherein the first audio test signal comprises a power spectral density (PSD) that is inversely proportional to its frequency, and wherein the transmitted first audio test signal is reflected within the room, and wherein the DSP is further adapted to process the reflected broadcast first audio test signal received by the microphone, generate and save a frequency-amplitude analysis of the received first audio test signal as an initial reference curve, periodically test the room in a substantially similar manner to generate one or more additional reference curves, and compare the one or more additional reference curves to determine whether they are within a known, predetermined tolerance of the initial reference curve.

According to the first aspect of the embodiments, the DSP is further adapted to generate a message if the additional reference curve exceeds the known, predetermined tolerance of the initial reference curve.

According to the first aspect of the embodiments, the PSD of the first audio test signal is substantially equal per octave of the first audio test signal.

According to the first aspect of the embodiments, the room monitoring system further comprises a network interface; network cabling; and a remote operating control system (ROCS), wherein the DSP is adapted to respond to commands remotely generated by the ROCS.

According to the first aspect of the embodiments, the commands can be one or more of a self-automated periodic testing and reporting command, a self-automated non-periodic testing and reporting command, and a remote manually instituted testing and reporting command.

According to the first aspect of the embodiments, the DSP is further adapted to compare the initial reference curve of the first audio test signal to the PSD of the transmitted first audio test signal to determine at which frequencies the initial reference curve deviates from the PSD of the transmitted first audio test signal, and generate gain coefficients to apply to a next transmitted audio signal that minimize the deviations between the initial reference curve of the first audio test signal to the PSD of the transmitted first audio signal.

According to a second aspect of the embodiments, a method is provided for monitoring audio equipment in a room, the method comprising: generating and transmitting by a digital signal processor (DSP), through a speaker, into a room, a first audio test signal that comprises a power spectral density (PSD) that is inversely proportional to its frequency; receiving, through a microphone, a reflected portion of the first audio test signal at the DSP; processing the received reflected portion of the audio test signal to generate and save a frequency-amplitude analysis of the received first audio test signal as an initial reference curve; periodically testing the room in a substantially similar manner to generate one or more additional reference curves; and comparing the one or more additional reference curves to determine whether they are within a known, predetermined tolerance of the initial reference curve.

According to the second aspect of the embodiments, the PSD of the audio test signal is substantially equal per frequency octave of the audio test signal.

According to the second aspect of the embodiments, the method further comprises generating commands from a remote destination to calibrate the room; transmitting the commands through a network interface to the DSP; and receiving the transmission coefficients at the remote destination.

According to the second aspect of the embodiments, the commands can be one or more of a self-automated periodic testing and reporting command, a self-automated non-periodic testing and reporting command, and a remote manually instituted testing and reporting command.

According to the second aspect of the embodiments, the method further comprises comparing the initial reference curve of the first audio test signal to the PSD of the transmitted first audio test signal to determine at which frequencies the initial reference curve deviates from the PSD of the transmitted first audio test signal; and generating and applying gain coefficients to a next transmitted audio signal that minimizes the deviations between the initial reference curve of the first audio test signal to the PSD of the transmitted first audio signal.

According to the second aspect of the embodiments, the step of generating transmission coefficients comprises: determining at which frequencies the room frequency response deviates in amplitude from the PSD of the transmitted audio test signal; measuring the deviations in amplitude between the room frequency response and the PSD of the transmitted audio test signal; and assigning transmission coefficients based on the measured deviations in regard to respective frequency ranges.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

DETAILED DESCRIPTION

Figure 1:
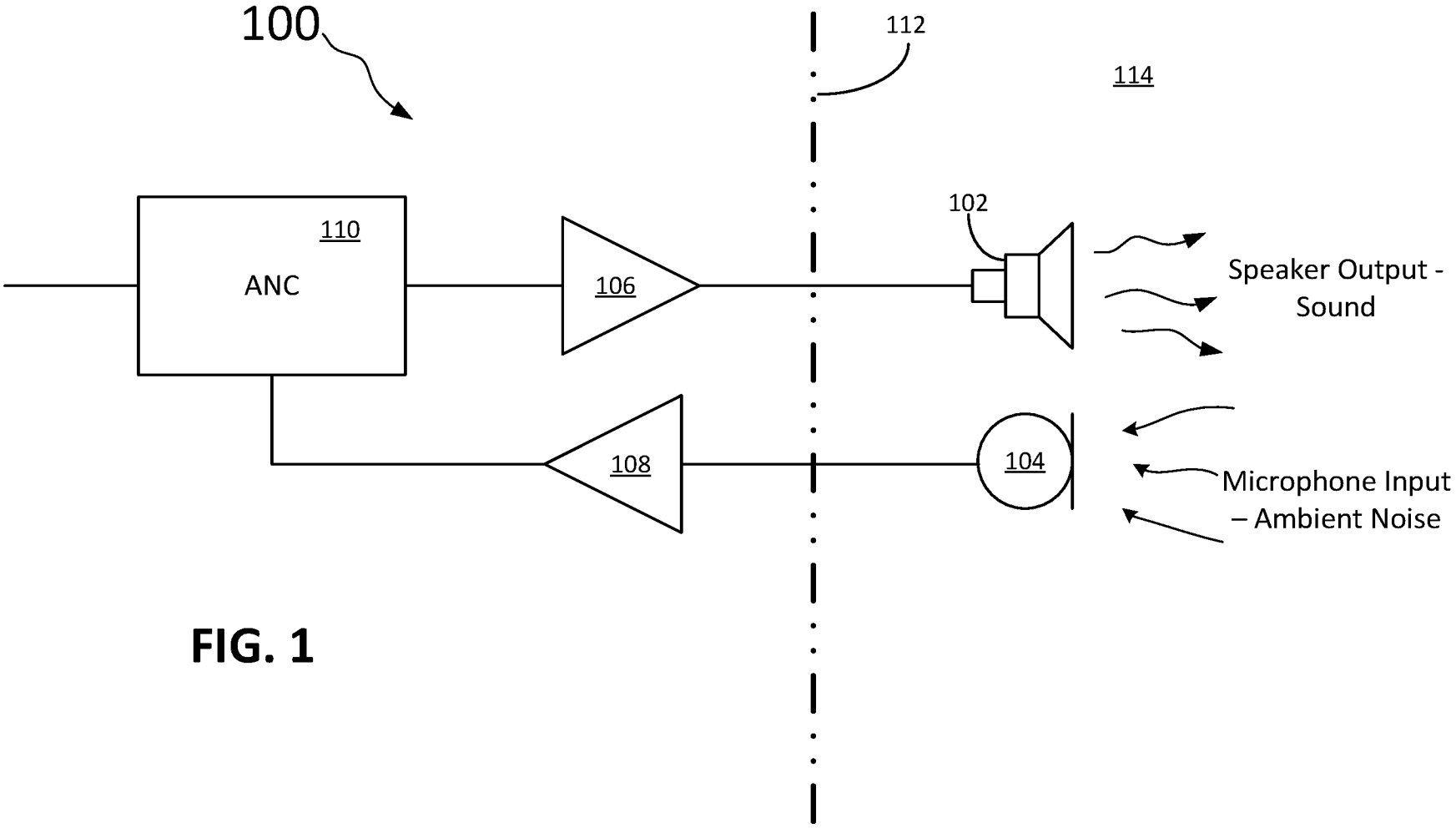
FIG. 1 illustrates a block diagram of a conventional ambient noise sensor system.

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices, such as digital signal processing equipment.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" or "in an embodiment" in various places throughout the specification is not necessarily referring to the same embodiment. Further, the particular feature, structures, or characteristics may be combined in any suitable manner in one or more embodiments.

List of Reference Numbers for the Elements in the Drawings in Numerical Order

The following is a list of the major elements in the drawings in numerical order.

100 Conventional Ambient Noise Sensor System (ANSS)
102 Speaker
104 Microphone (Mic)
106 Digital-to-Analog Converter (DAC)
108 Analog-to-Digital-Converter (ADC)
110 Ambient Noise Control Circuit (ANCC)
112 Wall
114 Acoustic Space
200 Ambient Noise Control System (ANCS)
202 Switch
204 Ambient Map Circuit
302 Announcement
304 Ambient Noise
402 Noise Level Correction Factor (NLCF)
502 Gate Signal
600 Method for Correcting an Audio Signal in the Presence of Ambient Noise
602-612 Steps of Method 600
700 Block Diagram of an Automated Network Operable Room Calibration System (Room Calibration System (RCS))
701 Input (I/P) Channel Strip
702 Digital Signal Processor (DSP)
704 Pink Noise Generator (PNG)
705 Output (O/P) Channel Strip
706 Pink Noise (PN)
707 Voice over Internet Protocol (VoIP) Telephone Interface
708 Reflected Pink Noise (RPN)
710 Spectrum Analyzer (SA)
712 Network Interface (NWI)
714 Network Cable
716 Network Accessible Server
718 Wired/Wireless Network Interface
720 Remote Network Server
722 Wired/Wireless Internet Connection
802 Input Limiter Function Block
804 Input Equalizer Function Block
806 Input Delay Function Block
808 Input Gate Function Block
810 Output Compressor Function Block
812 Output Equalizer Function Block
814 Output Delay Function Block
816 Output Limiter Function Block
902 Output Audio Signal
904 Ambient Noise Signal
1000 Reference Graph
1002 Reference Curve List of Acronyms Used in the Specification in Alphabetical Order The following is a list of the acronyms used in the specification in alphabetical order.

ADC Analog-to-Digital-Converter
ANCC Ambient Noise Control Circuit
ANCS Ambient Noise Control System
ANSS Ambient Noise Sensor System
BIOS Basic Input/Output System
CD Compact Disk
DAC Digital-to-Analog Converter
DSP Digital Signal Processor
DVD Digital Versatile Disk
EE-PROM Electrically Erasable Programmable Read Only Memory
EISA Enhanced Industry Standard Architecture
HDD Hard Disk Drive
IR Infrared
ISA Industry Standard Architecture
LAN Local Area Network
MCA Micro-Channel Architecture
Mic Microphone
NW Network
NWI Network Interface
NLCF Noise Level Correction Factor
PCI Peripheral Component Interconnect
PN Pink Noise
PNG Pink Noise Generator
RAM Random Access Memory
RCS Room Calibration System
RF Radio Frequency
RMS Root Mean Square
ROM Read Only Memory
SA Spectrum Analyzer
SMBus Systems Management Bus
SPL Sound Pressure Level
USB Universal Serial Bus
VESA Video Electronics Standard Architecture
VoIP Voice over Internet Protocol
WAN Wide Area Network
WL Wireless The different aspects of the embodiments described herein pertain to the context of systems, methods, and modes for determining and correcting for ambient audio conditions utilizing a minimum amount of equipment, as well as for substantially automated room monitoring systems, but is not limited thereto, except as may be set forth expressly in the appended claims.

For over 40 years Creston Electronics, Inc., has been the world's leading manufacturer of advanced control and automation systems, innovating technology to simplify and enhance modern lifestyles and businesses. Crestron designs, manufactures, and offers for sale, integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics Inc., located in Rockleigh, N.J.

Figure 2:
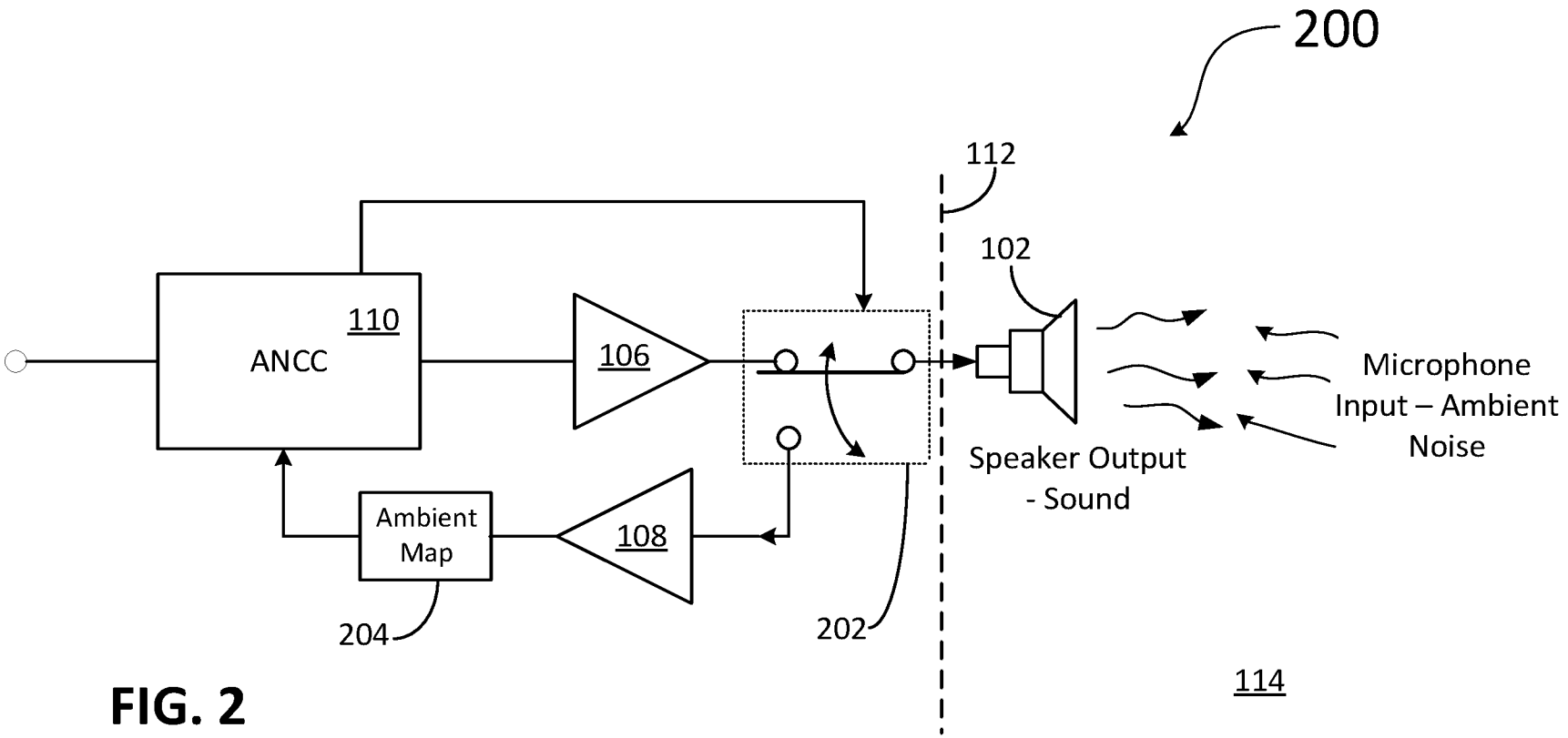
FIG. 2 illustrates a block diagram of an ambient noise control system according to aspects of the embodiments.

FIG. 2 illustrates a block diagram of ambient noise control system (ANCS) 200 according to aspects of the embodiments. ANCS 200 comprises several of the components of ANSS 100, including those of speaker 102, combined DAC 106, combined ADC 108, and ANCC 110. According to aspects of the embodiments, additional components that provide the ability to detect acoustical ambient audio noise with less components comprises switch 202, and ambient map circuit 204.

Using only speaker 102 as both a speaker and an ambient noise detecting microphone means that when replacing an existing audio distribution system, or in a new installation, a significant savings can be incurred through use of the aspects of the embodiments as there are fewer and less expensive components in the system installed according to aspects of the embodiments. In addition, because there are fewer discrete components, there is a savings in the accompanying costs of installing the new/replacement system according to aspects of the embodiments.

Figure 3:
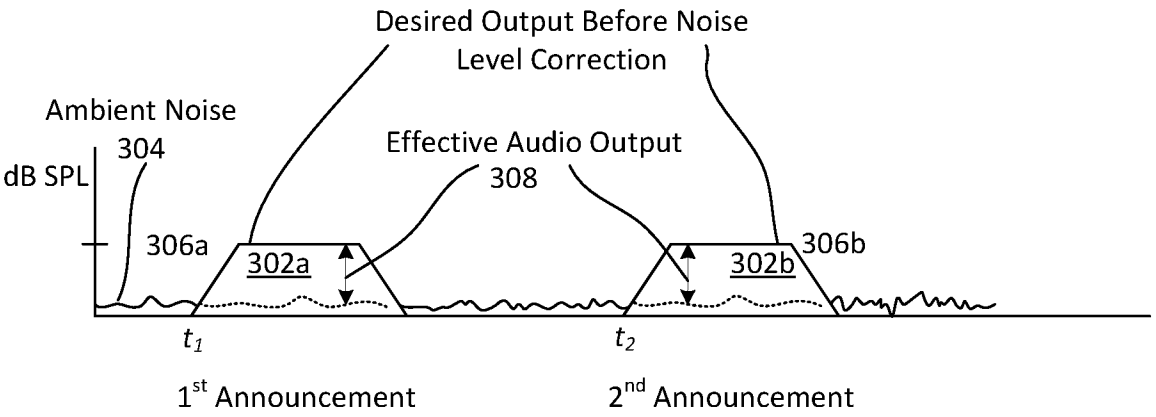
FIG. 3 illustrates a diagram of the amplitudes of noise and audio signals versus time prior to use of the ambient noise control system of FIG. 2.
Figures 4, 5:
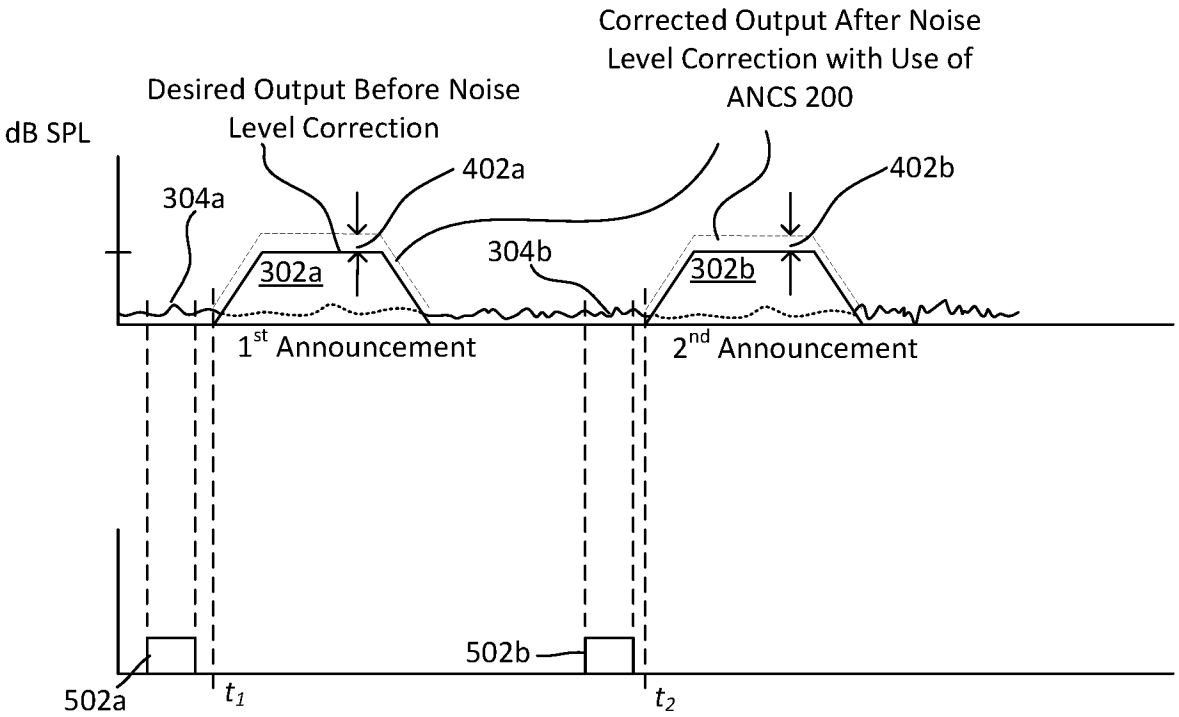
FIG. 4 illustrates a diagram of the amplitude of noise and audio signals versus time following the implementation and use of the ambient noise control system of FIG. 2 according to aspects of the embodiments.
FIG. 5 illustrates a pre-announcement gate signal that can be generated by an ambient noise control circuit that causes the ambient noise control circuit to measure ambient noise through a speaker according to aspects of the embodiments.

FIG. 3 illustrates a diagram of the amplitudes of noise and audio signals versus time prior to use of ANCS 200 of FIG. 2, and FIG. 4 illustrates a diagram of the amplitude of noise and audio signals versus time following the implementation and use of ANCS 200 of FIG. 2 according to aspects of the embodiments. In FIG. 3 first audio output 302*a* occurs at time $t_1$, with a duration of $\Delta t_1$, and is output at first transmitted audio power level 306*a*, and second audio output 302*b* occurs at time $t_2$, with a duration of $\Delta t_2$, and is output at second transmitted audio power level 306*b*.

As those of ordinary skill in the art can appreciate, in FIG. 3 the amplitude of the first and second announcements 302*a,b* is unchanged, even in the presence of ambient noise 304 (which can vary over time); this can cause some announcements to be more difficult to hear. In effect, the audio output has been reduced by the same amount of the magnitude of ambient noise 304 such that the effective audio output 306*a,b* is less than the desired audio output. For example, in a crowded mall setting, important public service announcements may need to be broadcast from time-to-time, and the presence of ambient noise, especially in crowded situations, could be problematic.

Attention is now directed towards FIGS. 4 and 5. FIG. 4 illustrates a diagram of the amplitude of noise and audio signals 304, 302 versus time following the implementation and use of ANCS 200 of FIG. 2 according to aspects of the embodiments, and FIG. 5 illustrates use of pre-announcement gate signal (gate signal 502) that can be generated by one or more components of ANCS 200 that causes ANCS 200 to measure ambient noise 304 through speaker 102 according to aspects of the embodiments.

According to aspects of the embodiments, "pre-announcement" gate signal (gate signal) 502 can be generated by a first component of ANCC 110. When gate signal 502 goes active, it causes switch 202, which normally connects terminals 1 and 3 (as shown in FIG. 2; terminal 1 being connected to the output of DAC 106 (the audio output)), to switch so that terminal 3, which is connected to the driver of speaker 102, to be connected to terminal 2, which is connected to the input of ADC 108. Once the drive signal to speaker 102 is lost, speaker 102 ceases to operate as a transducer broadcasting audio, and now operates as a transducer converting ambient acoustic noise energy 304 to electrical signals. It is these electrical signals that are then input to ADC 108. In this manner, ANCC 110 measures any ambient noise 304 that might be present through speaker 102. Ambient noise 304 is received by speaker 102, and output to ADC 108, which converts it to a digital signal, which is then received by ambient map circuit 204, and ANCC 110.

Ambient noise 304 is measured for a predetermine amount of time—the duration of gate signal 502, as shown in FIG. 5. According to aspects of the embodiments, the duration of gate signal 502 depends on several factors, including the processing speed of the circuitry within ANCS 200, and the relative amplitude and type of ambient noise 304 (noise that is irregular might need to be sampled over a longer period of time, then averaged). Following measurement of ambient noise 304, the level of gate signal 502 is changed such that switch 202 connects terminal 1 to terminal 3, so that the audio signal (output of DAC 106), in this non-limiting example announcement 302, can be broadcast by speaker 102 according to aspects of the embodiments.

Ambient map circuit 204 performs a spectral analysis on the received audio signal as acquired by speaker 102 acting as a microphone, and substantially differentiates the noise spectrum from the audio spectrum according to aspects of the embodiments. According to further aspects of the embodiments, a copy of the soon-to-be broadcast audio signal can be forwarded to ambient map circuit 204 so that it can perform a preliminary spectral analysis on the known or expected audio signal 302 and compare it to measured ambient noise 304. Knowing the spectral analysis of the announcement beforehand allows ambient map circuit 204 to more accurately determine the magnitude of ambient noise 304 when it is measured during the interval of gate 502; it can therefore generate gain values for just the spectral values of announcement 302 that can become part of noise level correction factor NLCF 402 according to aspects of the embodiments. According to further aspects of the embodiments, ambient map circuit 204 generates NLCF 402 that can be applied to the announcement prior to audio transmission in ANC 110.

Referring now to FIGS. 4 and 5, first ambient noise signal 304*a* is measured by ANCS 200 during the time period of first and second gate signals 502*a,b*. The measurement duration is about the duration of first and second gate signals 502*a,b*. The measurement time is generally just before first and second announcements 302*a,b* are broadcast, in order to obtain the most accurate information regarding ambient noise. The timing of first and second gate signals 502*a,b* in regard to first and second announcements 302*a,b* is shown by the dashed lines extending from first and second gates 502*a,b*, in FIG. 5, to FIG. 4, where first and second ambient noise signals 304*a,b* are shown. Processing and generation of first and second NLCF 402*a,b* can occur during and after first and second gate signals 502*a,b*, respectively, such that first NLCF 402*a* can be applied to first announcement 302*a*, and similarly, second NLCF 402*b* be applied to second announcement 302*b* in view of second ambient noise signal 304*b*.

According to aspects of the embodiments, NLCF 402 can be a time average value of ambient noise 304 as determined by ambient map circuit 204, or it can be a weighted value, a maximum value, A historical average, root-mean-square (RMS) value of ambient noise signal 304, among other types of determinations/calculations of ambient noise level 304, using known or novel statistical processes, according to aspects of the embodiments. Once the level of ambient noise 304 is measured, a corresponding amount of gain (NLCF 402) can be added to the signal level of announcement 302 when it is broadcast shortly after the measurement of the ambient noise level, which occurs during gate 502.

According to further aspects of the embodiments, if there are multiple speakers 102 in an area, processing can be done individually at each speaker 102, or there can be a central processing unit that averages all of the detected ambient noise levels, and instructs all of the audio amplifiers to provide a specific amount of gain. According to further aspects of the embodiments, there can be a centrally located ambient noise detector circuit that measures noise in one location, and ANCS 200 can use that value in one or more locations. Further still, according to further aspects of the embodiments, there can be a central processing location and it can either receive one or more ambient noise levels and use one or more of them, e.g., using an average or some other statistical analysis, or, it can allow individual amplifiers to use their own locally generated ambient noise levels.

Figure 6:
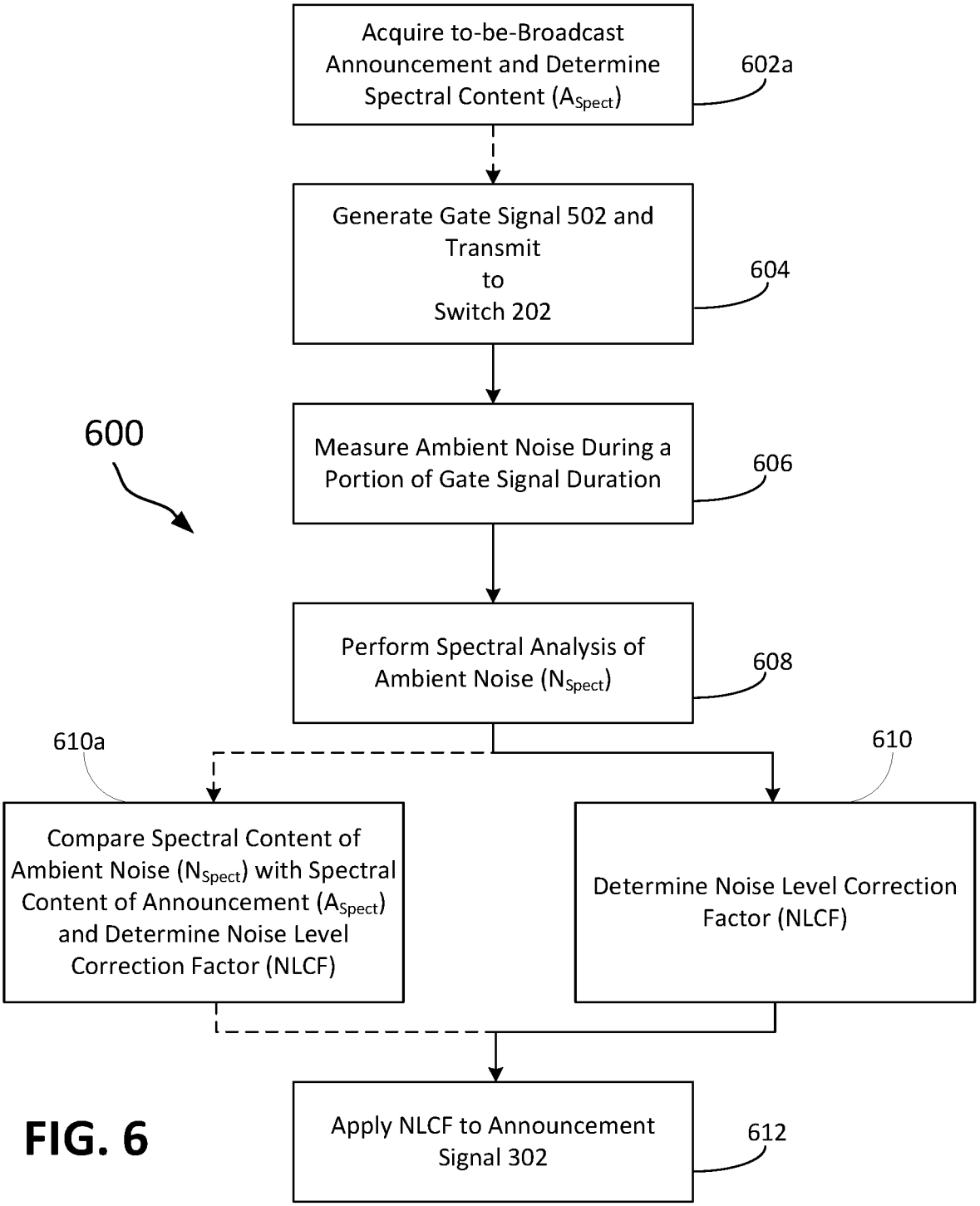
FIG. 6 illustrates a flow chart of a method for correcting an audio signal in the presence of ambient noise according to aspects of the embodiments.

Attention is now directed towards FIG. 6, which illustrates a flow chart of method 600 for correcting an audio signal in the presence of ambient noise (method 600) according to aspects of the embodiments. Method 600 begins with optional method step 602*a* in which ambient map circuit 204 acquires the spectral content of the soon-to-be-broadcast announcement 302; according to non-limiting aspects of the embodiments, step 602*a* can be omitted. In method step 604, ANC 110 generates gate signal 502 and transmits it to switch 202, and optionally to ambient map circuit 204. In method step 606, ambient map circuit 204 measures ambient noise 304; according to aspects of the embodiments, one reason for ambient map circuit 204 to receive gate signal 502 is to know in advance when ambient noise 304 is going to be received so that the correct spectral energy can be used in determining NLCF 402.

Following method step 606, ambient map circuit 204 performs a spectral analysis of ambient noise 304 in method step 608, and in method step 610 ambient map circuit 204 determines NLCF 402 in the manner as described above. According to further aspects of the embodiments, following method step 608, method step 610*a* can occur. In optional method step 610*a,* method 600 compares the spectral content of the ambient noise (determined in method step 608), and compares it to the spectral content of the soon-to-be broadcast announcement 302, and then determines NLCF 402. In method step 612 the most recently determined NLCF 402 (e.g., the one determined in method step 610, 610*a*), is forwarded to ANCC 110 and applied to the next announcement 302.

According to further aspects of the embodiments, the comparison that occurs in method step 610*a* of method 600 can include a comparison of the total energy in each spectrum. According to further aspects of the embodiments, an integration of the energy over the frequency spectrum occurs for each signal return. The two integrated energies are then compared, and if the total energy of the ambient noise exceeds the total energy of the announcement, the NLCF is determined by its relative difference or other arithmetic operation. According to further aspects of the embodiments, the comparison can be of the energy in the spectral regions outside of the speech portion of both of the announcement and the ambient noise signal (partial integrated energy). The two partial integrated energies of the spectral regions outside the audio spectrum are then compared, and if the partial integrated energy of the ambient noise exceeds the partial integrated energy of the announcement, the NLCF is determined by its relative difference other arithmetic operation.

Figure 9:
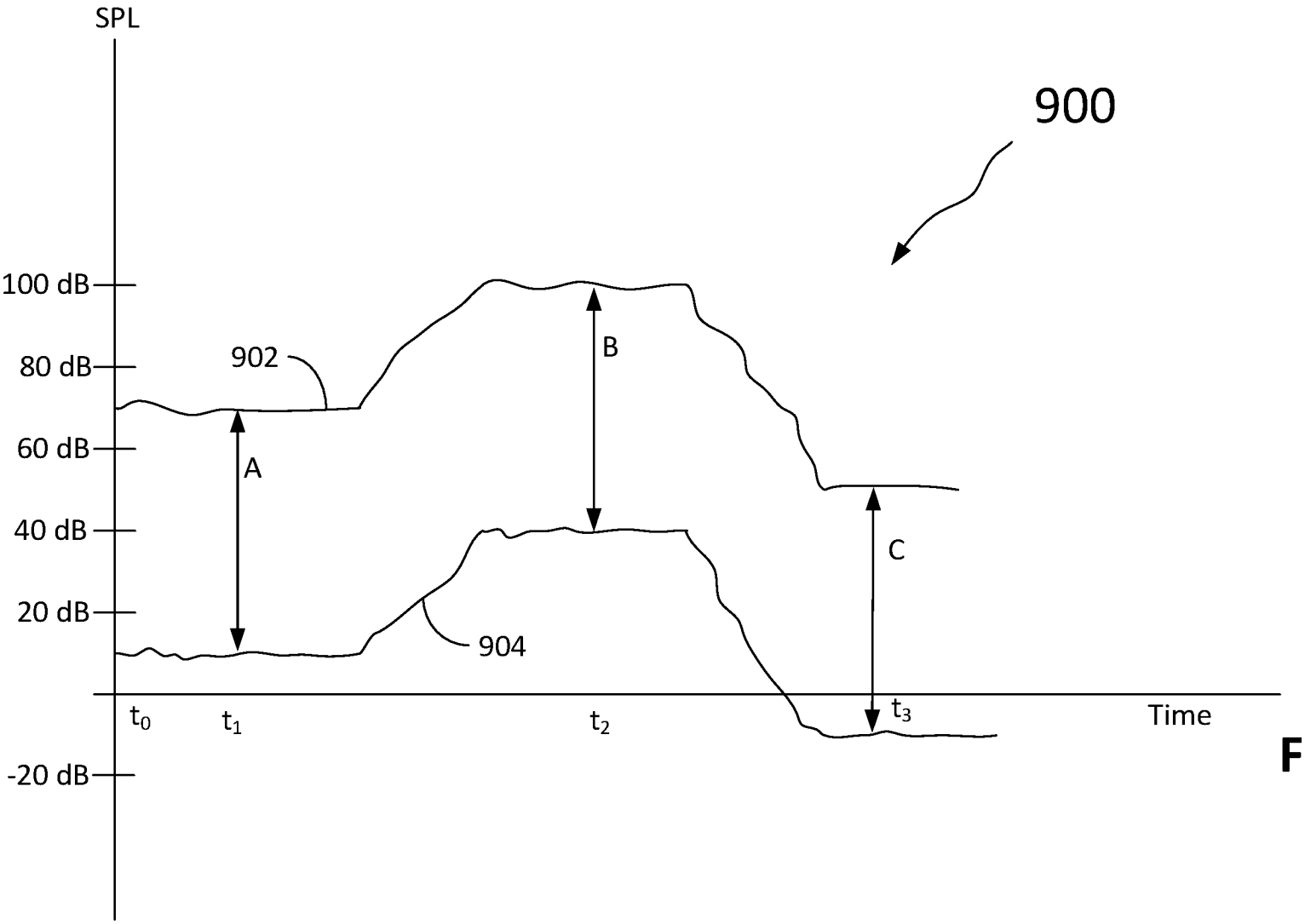
FIG. 9 illustrates a graph of in output audio signal when processed by the ambient noise control system shown in FIG. 2 in the presence of ambient noise signal.

FIG. 9 illustrates a graph of output audio signal 902 when processed by ANCS 200 shown in FIG. 2 in the presence of ambient noise signal 904. FIG. 9 is also related to FIGS. 4 and 5, in that FIG. 9 illustrates a substantially continuous audio signal 902 being generated using ANCS 200 in the presence of a changing ambient noise signal 904 according to aspects of the embodiments, whereas, for purposes of illustration only, FIGS. 4 and 5 are "snapshots" of a sampling of the ambient noise signal 904. In FIG. 9, just prior to time $t_0$, ANCS 200 intended to broadcast audio signal 902 at an output power level of about 60 dB. However, it was determined by ANCS 200 that ambient noise signal 904 had a power level of about 10 dB, and thus 10 dB was added to output audio signal 902, raising it to about 70 dB. During the $t_1$ time period, the signal-to-noise ratio, which while is technically defined as the ratio of the power of the output audio over the power of the ambient noise, can also, in general, be represented by the difference between the power levels of output audio signal 902 and ambient noise signal 904, as shown by line A. In this case, the signal-to-noise difference is about 60 dB (70 dB-10 dB).

In time period $t_2$, however, the power of ambient noise level 904 increased by about 30 dB, to about 40 dB. ANCS 200 measured power level of ambient noise level 904 and added the amount of gain (about 30 dB), to amplifier 106, such that the output power level of output audio signal 902 is now about 100 dB (70 dB+30 dB=100 dB). As previously, outputting a higher power level of output audio signal 902 maintains the original signal-to-noise difference in view of the higher power level of ambient noise signal 904.

In time period $t_3$, the power level of ambient noise signal 904 has decreased to about −10 dB, which is about a 50 dB loss. Because ANCS 200 is substantially constantly measuring the power level of ambient noise signal 904 it determines the new power level of ambient noise signal 904 and in order to maintain the desired signal-to-noise difference, it therefore cuts the power output of amplifier 106, such that the new power level is 50 dB lower than the previous power level. Output signal 902 goes from about 100 dB to about 50 dB. The difference at all of lines A, B, and C is about 60 dB (line A, time period $t_1$: 70 dB−10 dB=60 dB; line B, time period $t_2$: 100 dB−40 dB=60 dB; and line C time period $t_3$ 50 dB−(−10 dB)=60 dB). Thus, a substantially constant SNR is maintained.

Figure 7:
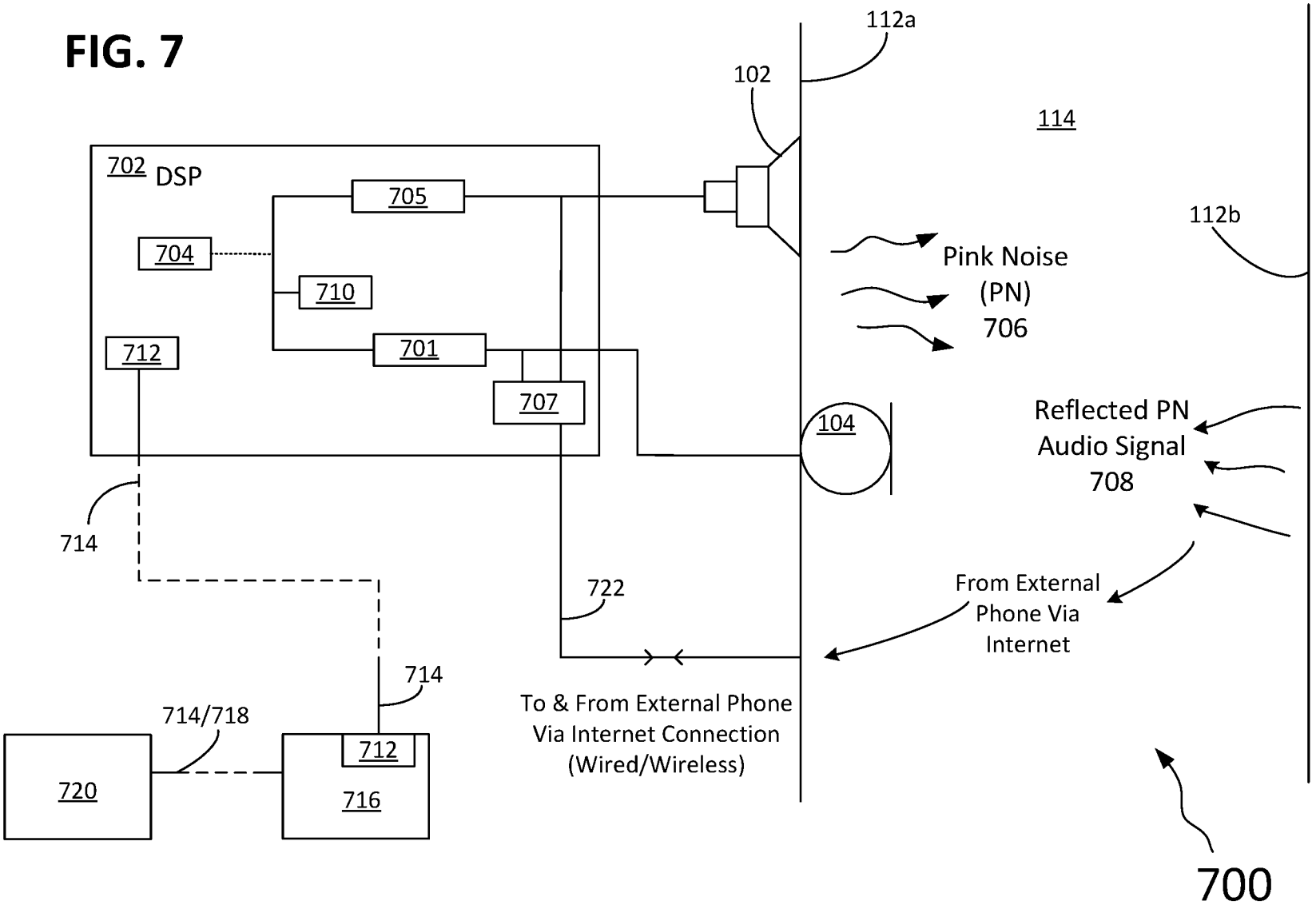
FIG. 7 illustrates a block diagram of an automated network operable room monitoring system according to aspects of the embodiments.

Attention is now directed to FIG. 7, which illustrates block diagram of automated network operable room calibration system (room calibration system (RCS)) 700 according to aspects of the embodiments. RCS 700 comprises, among other items, speaker 102, microphone 104, digital signal processor (DSP) 702, network interface (NWI) 712, network cable 714 (connecting NWIs 712 to each other), network servers 716, wired/wireless interfaces 718, and remote network server 720 according to aspects of the embodiments. As those of skill in the art can appreciate, one or more of the network components do not necessarily need to be part of RCS 700, but do facilitate remote access, monitoring, testing, and correction. According to further aspects of the embodiments, DSP 702 comprises input channel strip 701, pink noise generator (PNG) 704, output channel strip 705, voice-over-internet protocol telephone interface 707, spectrum analyzer (SA) 710, and network interface 712. Among many other functions, DSP 702 manages all of the components within it, and also communicates to externally and remotely located users. Input channel strip 701, discussed in greater detail in regard to FIG. 8, processes received audio signals according to various functions as represented by blocks shown in FIG. 8, and output channel strip 705 performs similar type processing for output audio signals, with the same or different function blocks, also as shown and discussed in regard to FIG. 8. VoIP interface is discussed in greater detail below. SA 710 performs digital Fourier Transforms on the transmitted and received audio signals to determine their frequency response according to digital signal manipulations, as known to those of skill in the art.

Figure 10:
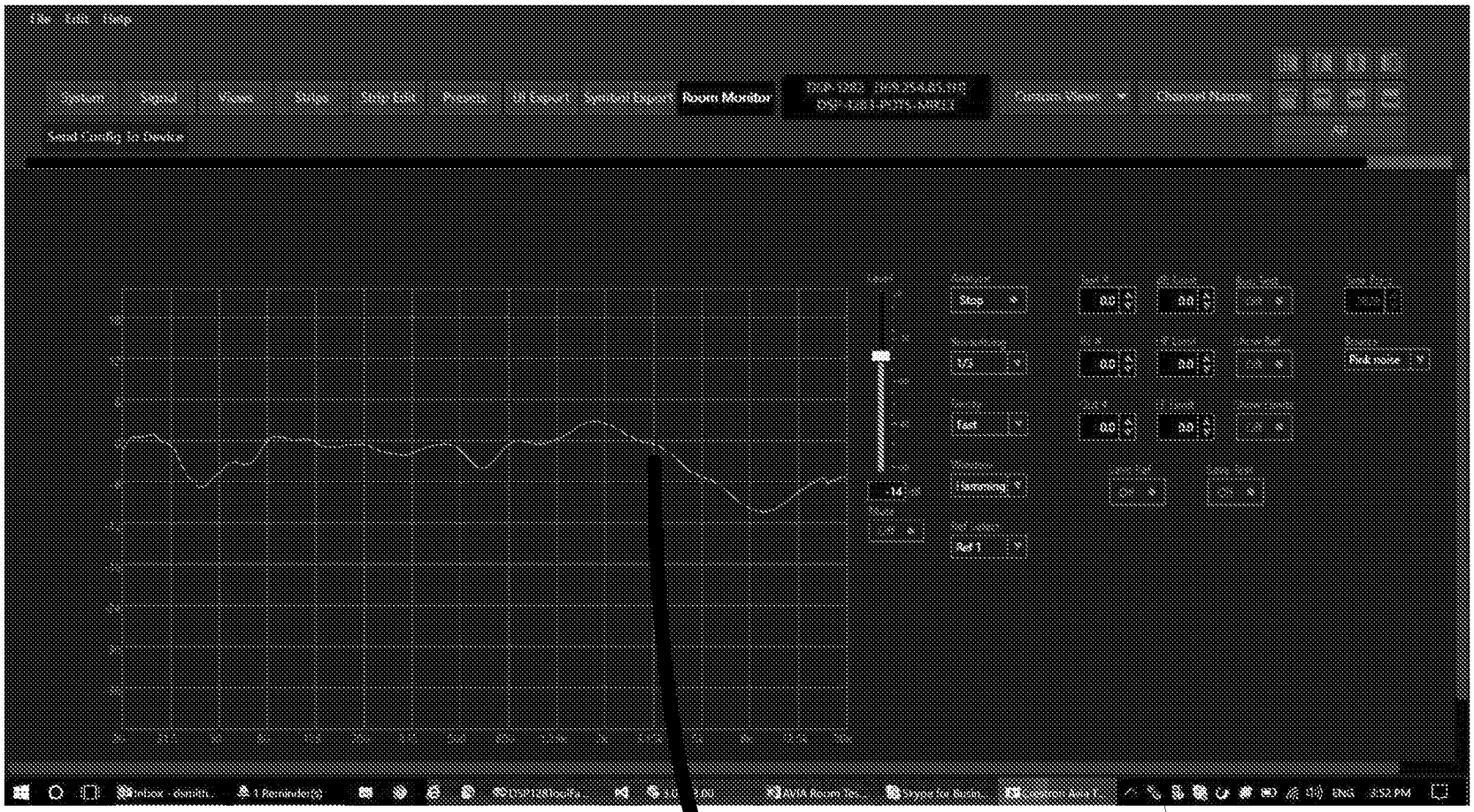
FIG. 10 illustrates a reference curve on a reference graph as generated by the room monitoring system as shown in FIG. 7.

Room calibration is the process of first determining the spectral response of the room, and then, if desired, "tuning" the room to create a high fidelity audio environment, i.e., one in which the spectral/acoustic characteristic of the room is substantially "flat," meaning no "bumps," "dips," "peaks," "valleys," etc., in the spectrum/frequency response of the room (or acoustic space) 114). The spectral response of the room is represented by reference signal 1002, as shown in FIG. 10. RCS 200 can then manipulate the output signal, if desired, to provide gains at frequencies in which there are drop-offs, dips, or valleys (meaning there is some kind of signal attenuation at those points), and provide attenuation where there are peaks (or gains) in the frequency response.

According to aspects of the embodiments, a step in the process for obtaining such a flat response is to use PNG 704 that is a component of DSP 702 to obtain reference signal 1002, which is shown and described in reference to FIG. 10. PNG 704 can be used to output a special audio signal, pink noise (PN) 706, which ranges in frequency from about 20 Hz to about 20 KHz. PN 706 is characterized by its power spectral density (PSD) being inversely proportional to its frequency. That is, as the frequency of PN 706 increases, the power decreases. In particular, there is substantially equal power spectral density energy per octave. An octave is a doubling of frequency: 20 Hz to 40 Hz, 40 Hz to 80 Hz, etc.). In this example, the first octave is 20 Hz to 40 Hz; the second octave 40-80 Hz, and the third octave is 80-160 Hz, and so on. Lower frequencies are therefore more heavily weighted, as this is the way people hear, i.e., they hear better at lower frequencies. According to further aspects of the embodiments, the first octave can start at a different frequency such as 30 Hz, or 40 Hz, among others. By definition, however, an octave is a doubling of frequency; thus, if the octaves were to start at 30 Hz, they would proceed from 30-60 Hz, 60-120 Hz, 120-240 Hz, and so on. According to further aspects of the embodiments, white noise can also be used, wherein the energy is substantially equal per frequency band, i.e., a constant power spectral density.

According to aspects of the embodiments, SA 710, which is a component of DSP 702, can be used to determine the frequency response for room 114, in particular, according to an aspect of the embodiments, by using an Omni-directional microphone 104 that picks up or receives reflected PN (RPN) 708. As those of skill in the art can appreciate, SA 710 measures and displays audio power versus frequency. The response or signal generated by SA 710 can be referred to as reference curve 1002, as shown in FIG. 10, in which reference curve 1002 is located on reference graph 1000. If reference curve 1002 as generated by SA 710 indicates a non-flat response of RPN 708, the user can implement filters with adjustable gain coefficients (+/−) to be applied to the output signals, to level out the response for the room. For example, referring to FIG. 10, on graph 1000, reference curve 1002 drops to about −12 dB at about 8 KHz. A gain coefficient of about 12 dB could be added in or about at this frequency to transmitted audio in order to flatten out the response (−12 dB+12 dB=0 dB (which is a flat response)). Crestron Electronics, Inc., headquartered in Rockleigh, N.J., manufactures a DSP that includes PNG 704 and SA 710, and is network compatible (i.e., that includes one or more NWIs 712). According to further aspects of the embodiments, the Fusion Network as manufactured by Crestron includes such a DSP. Individual DSPs 702 as manufactured by Crestron can be located in different rooms and their results collected by network accessible server (server) 716 that includes Fusion network software, among other types of network and interface software. This provides a very efficient manner in which to equalize a room and perform periodic maintenance so that as the audio equipment ages, the audio response of the room can be monitored and corrected if the response becomes non-flat over time.

According to aspects of the embodiments, and a non-limiting example, DSP 702 can provide substantially automatic spectral analysis/equalization and send/receive information via the cloud (Fusion), so that when problems occur, technicians can alert the property owners that problems can be developing within the acoustic space (e.g., room 114). Thus, self-test, diagnosis, and reporting measurements/metrics can be done automatically, semi-automatically, and/or manually, and all of these features can be controlled remotely.

According to further aspects of the embodiments, RCS 200 can be used to test the round trip path duration of a telephony interface, and this information can be further used for diagnostic purposes. As shown in FIG. 7, the output of output channel strip 705 can be directed to an external phone (not shown) via voice over Internet protocol telephone interface (VoIP interface) 707 and wired/wireless internet connection (internet connection) 722, and the return VoIP signal can be directed to input channel strip 701 according to aspects of the embodiments. In a substantially similar manner as that of characterizing room 114, RCS 700 can initiate a call to a number, transmit pink noise signal 706, measure a response time, listen to and store the responding signal, and characterize the frequency response of the internet telephony connection as desired.

Figure 8:
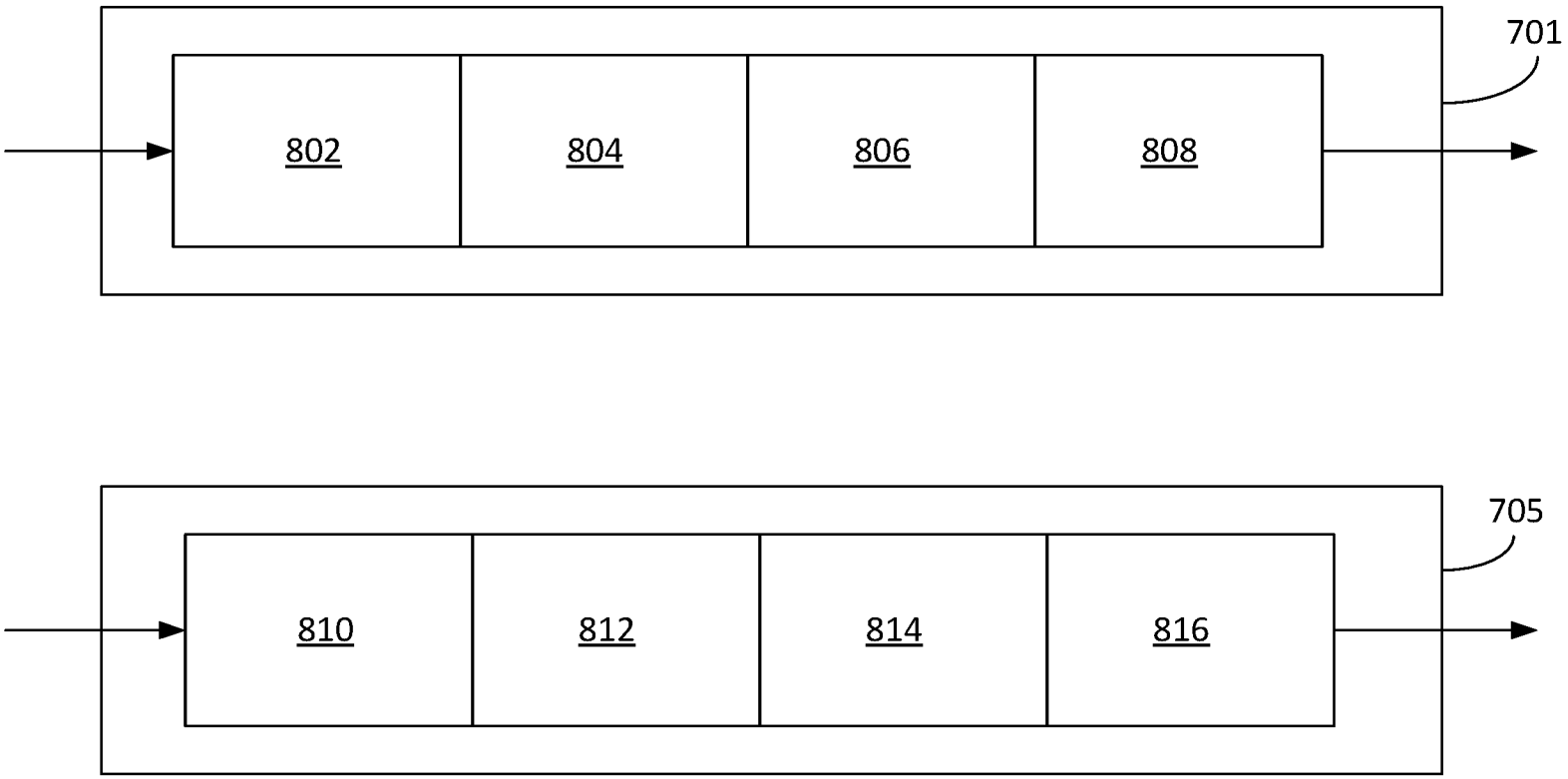
FIG. 8 illustrates a detailed view of an input channel strip and an output channel strip for use in the room monitoring system shown in FIG. 7.

Referring now to FIG. 8, there is shown detailed block diagrams of both input channel strip 701 and output channel strip 707, as used within RCS 700 according to aspects of the embodiments. Input channel strip 701 comprises input limiter 802, input equalizer 804, input delay 806, and input gate 808. Output channel strip comprises output compressor 810, output equalizer 812, output delay 814, and output limiter 816. Each of these devices, which can collectively be referenced to as "audio objects," will be discussed in turn.

A compressor is a device that reduces, or compresses, the level of signals that exceed a certain threshold, while leaving lower level signals unaffected. This reduces the dynamic range of the audio signal. A limiter is a compressor with a high ratio, and generally, a fast attack time. Limiters are common as a safety device in live sound and broadcast applications to prevent sudden volume peaks from occurring. Another such audio object is a compressor. Compressors and limiters help audio devices avoid clipping.

Another such audio object is a delay. Delay is defined as the computational delay of a block or subsystem, and is related to the number of operations involved in executing that block or subsystem in a DSP system. Another such audio object is a noise gate. A noise gate is an electronic device or software logic that is used to control the volume of an audio signal. In its most simple form, a noise gate allows a signal to pass through only when it is above a set threshold: the gate is open. If the signal falls below the threshold no signal is allowed to pass: the gate is closed. A noise gate does not remove noise from the signal. When the gate is open both the signal and the noise will pass through. Band-limited noise gates are also used to eliminate background noise from audio recordings by eliminating frequency bands that contain only static. A noise gate is used when the level of the 'signal' is above the level of the 'noise.' The threshold is set above the level of the 'noise' and so when there is no 'signal' the gate is closed. Noise gates often implement hysteresis, that is, they have two thresholds. One to open the gate and another, set a few dB below, to close the gate. This means that once a signal has dropped below the close threshold, it has to rise to the open threshold for the gate to open, so that a signal that crosses over the close threshold regularly does not open the gate and cause chattering. A longer hold time helps avoid chattering.

Another such audio object is a matrix mixer. A matrix mixer is a device that routes multiple input audio signals to multiple outputs. It usually employs level controls, such as potentiometers, to determine how much of each input is going to each output, and it can incorporate simple on/off assignment buttons. The number of individual controls is at least the number of inputs multiplied by the number of outputs. Matrix mixers can be incorporated into larger devices such as mixing consoles or they may be a standalone product. They always have routing and level controls and can also include other features. Matrix mixers are often used in a complex listening space to send audio signals to different loudspeaker zones. They can be used to provide the producer or director different blends of a mixing project for television, film or recording studio.

Another such audio object is an automixer. An automixer is a live sound mixing device that automatically reduces the strength of a microphone's audio signal when it is not being used. Automixers lower the hiss, rumble, reverberation and other extraneous noise that occur when several microphones operate simultaneously. They can also be used to mix sound from non-microphone signals such as playback devices.

Another such audio object is automatic gain control (AGC). AGC is an audio block that adaptively adjusts its gain to achieve a constant signal level at the output.

Another such audio object is crossover circuit. A crossover circuit is a circuit or device that divides the signal output from the power amplifier into different frequency bands for the different drivers—woofer, midrange, and tweeter—for example. Different frequency bands can be separated digitally. Each band can then be amplified or attenuated, or further processed as desired.

Another such audio object is a spectrum analyzer (SA). A spectrum analyzer displays signal information such as voltage, power, period, wave shape, sidebands, and frequency. They can provide the user with a clear and precise window into the frequency spectrum. Another such audio object are filters. Filters are typically generated in the forms of a low pass filter (LPF), high pass filter (HPF), band pass filter (BPF), notch filter, and parametric equalization, among other types.

Another such audio object is an equalizer. An equalizer is a software or hardware filter that adjusts the loudness of specific frequency bands. Equalizers can be divided into ranges, or frequency bands. In a most simple form, basic car stereos, for example, will have a treble (higher frequencies) and a bass (lower frequencies) setting; each can be lowered or raised independently of the other. More expensive and sophisticated equalization systems can have as many as 12 frequency bands, or even more. The more bands (a professional audio mixing board can have 20 or 30 bands) an equalizer has, the smaller frequency range of the bands, and the more precisely a an audio engineer/user can control the frequency response of the sound/audio signal.

Another such audio object is ducking. Ducking is the process of lowering the output of one channel as another is raised. In ducking, the level of one audio signal is reduced by the presence of another signal. In radio this can typically be achieved by lowering (ducking) the volume of a secondary audio track when the primary track starts, and lifting the volume again when the primary track is finished. A typical use of this effect in a daily radio production routine is for creating a voice-over: a foreign language original sound is dubbed (and ducked) by a professional speaker reading the translation. Ducking becomes active as soon as the translation starts. In music, the ducking effect is applied in more sophisticated ways where a signal's volume is delicately lowered by another signal's presence. Ducking here works through the use of a "side chain" gate. In other words, one track is made quieter (the ducked track) whenever another (the ducking track) gets louder. This may be done with a gate with its ducking function engaged or by a dedicated ducker.

As further shown in FIG. 7 is remote network server 720, which can be connected to server 716 via one or more of a wide area network (WAN), local area network (LAN), micro-networks, the Internet, a satellite based network, and any other type of network currently available, or which can become available in the future. Remote server 720 allows remote operation of DSP 702, in both an autonomous manner, or manual manner. In addition, more than one DSPs 702 can be networked together, for different rooms, or one DSP 702 can calibrate more than one room, and all of the room's calibrations can be scheduled in advance on a periodic or non-periodic basis. Users can monitor the collected data, and generate reports, and use that information to track the lifespan of the components of the RCS 700, including, for example speaker(s) 102, which can degrade over time.

According to further aspects of the embodiments, RCS 700 can be used to schedule conference room acoustic performance tests remotely via a Crestron implemented FUSION system; the performance of DSP 702 can be evaluated, as well as mic 104, and speaker 102. If problems are detected, by comparing a recently obtained reference curve 1002*b* with the original reference curve 1002*a*, system maintenance personnel can be alerted either automatically, or via a manually sent electronic mail message, or via some other means. That is, in the subsequent tests of room 114, RCS 700 can generate a second reference curve 1002*b* and determine whether it is within a known, predetermined tolerance of the initial reference curve 1002*a*. If second reference curve 1002 is within the known predetermined tolerance of first reference curve 1002*a*, then no action need be taken; if, however, any of the values, or portions of second reference curve 1002 exceed the known predetermined tolerances of first reference curve 1002*a*, then remedial action can be prescribed, such as inspecting room 114 and determining which of the components need to be replace/repaired/refurbished.

Initial testing (to determine initial reference curve 1002*a*) can be implemented during installation, and maintenance testing done at virtually any time of the day or night, on any day of the year. The Crestron FUSION system can integrate and automate testing, test data retention and reporting, and manage sending alerts automatically, if desired. A substantially similar capability exists for testing, monitoring, and reporting in regard to the telephony interface and through use of VoIP interface 707 according to aspects of the embodiments. Both types of tests can be controlled via Crestron FUSION, and can be scheduled to occur at periodic times, or only when requested/called-up and manually initiated. Pass or fail status can be determined relatively quickly, and provided to the desired personnel.

According to a further aspect of the embodiments, reference curve 1002*a* can also be compared to the power spectral density (which, in essence, is also a reference curve) of the transmitted signal, PN 706; in an ideal, perfectly reflective environment, RPN 708 would substantially perfectly replicate transmitted PN 706. Since perfectly reflective rooms 114 do not, in practice, exist, reference curve 1002*a* can be compared to the PSD of PN 706 and gain coefficients can be generated that equalize reference curve 1002*a* to the PSD of PN 706. These gain coefficients can then be applied to subsequently transmitted audio signals, according to aspects of the embodiments.

As described above, an encoding process is discussed in reference to FIG. 6. The encoding process is not meant to limit the aspects of the embodiments, or to suggest that the aspects of the embodiments should be implemented following the encoding process. The purpose of the encoding process is to facilitate the understanding of one or more aspects of the embodiments and to provide the reader with one or many possible implementations of the processed discussed herein. FIG. 6 illustrates a flowchart of various steps performed during the encoding process. The steps of FIG. 6 are not intended to completely describe the encoding process but only to illustrate some of the aspects discussed above.

Aspects of the embodiments can be implemented in a suitable computing system environment. The computing system environment is only one example of a suitable computing environment and is not intended to suggest any limitation as to the scope of use or functionality of aspects of the embodiments. Neither should the computing environment be interpreted as having any dependency or requirement relating to any one or combination of components as described herein.

Aspects of the embodiments are operational with numerous other general purpose or special purpose computing system environments or configurations. Examples of known computing systems, environments, and/or configurations that can be suitable for use with aspects of the embodiments include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

Aspects of the embodiments can be described in the general context of computer-executable instructions, such as program modules, being executed by a computer. Generally, program modules include routines, programs, objects, components, data structures, etc. that perform particular tasks or implement particular abstract data types. Aspects of the embodiments can also be practiced in distributed computing environments where tasks are performed by remote processing devices that are linked through a communications network or other data transmission medium, as described in regard to FIG. 7, for example. In a distributed computing environment, program modules and other data can be located in both local and remote computer storage media including memory storage devices.

A computer system for implementing aspects of the embodiments includes a general purpose computing device in the form of a computer. Components of the computer can include, but are not limited to, a processing unit, a system memory, and a system bus that couples various system components together, including the system memory to the processing unit. The system bus can be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, Peripheral Component Interconnect (PCI) bus (also known as Mezzanine bus), Peripheral Component Interconnect Express (PCI-Express), and Systems Management Bus (SMBus).

The computer typically includes a variety of computer readable media. Computer readable media can be any available media that can be accessed by computer and includes both volatile and non-volatile media, removable and non-removable media. By way of example, and not limitation, computer readable media can comprise computer storage media and communication media. Computer storage media includes volatile and non-volatile, removable and non-removable media implemented in any method or technology for storage of information such as computer readable instructions, data structures, program modules or other data. Computer storage media includes, but is not limited to, random access memory (RAM), read only memory (ROM), electrically erasable programmable read only memory (EEPROM), flash memory or other memory technology, compact disk ROM (CD-ROM), digital versatile disks (DVD) or other optical disk storage, magnetic cassettes, magnetic tape, magnetic disk storage or other magnetic storage devices, or any other medium which can be used to store the desired information and which can accessed by computer. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency (RF), infrared (IR), and other wireless (WL) media. Combinations of any of the above should also be included within the scope of computer readable media.

The system memory includes computer storage media in the form of volatile and/or non-volatile memory such as ROM, and RAM. A basic input/output system (BIOS), containing the basic routines that help to transfer information between elements within the computer, such as during start-up, is typically stored in ROM. RAM typically contains data and/or program modules that are immediately accessible to and/or presently being operated on by processing unit.

The computer can also include other removable/non-removable, volatile/non-volatile computer storage media. The computer can further include a hard disk drive that reads from or writes to non-removable, non-volatile magnetic media, a magnetic disk drive that reads from or writes to a removable, non-volatile magnetic disk, and an optical disk drive that reads from or writes to a removable, non-volatile optical disk, such as a CD-ROM or other optical media. Other removable/non-removable, volatile/non-volatile computer storage media that can be used in the exemplary operating environment include, but are not limited to, magnetic tape cassettes, flash memory cards, digital versatile disks, digital video tape, solid state RAM, solid state ROM, and the like. The hard disk drive (HDD) is typically connected to the system bus through a non-removable memory interface such as a internal bus, and the magnetic disk drive and optical disk drive are typically connected to the system bus by a removable memory interface.

The drives and their associated computer storage media, discussed above, provide storage of computer readable instructions, data structures, program modules and other data for the computer. An HDD can store the operating system, application programs, other program modules, and program data. Note that these components can either be the same as or different from the operating system, application programs, other program modules, and program data. A user can enter commands and information into the computer through input devices such as a keyboard and pointing device, commonly referred to as a mouse, trackball or touch pad. Other input devices (not shown) can include a microphone, joystick, game pad, satellite dish, scanner, or the like. These and other input devices are often connected to the processing unit through a user input interface that is coupled to the system bus, but can be connected by other interface and bus structures, such as a parallel port, game port, or a universal serial bus (USB). A monitor or other type of display device is also connected to the system bus via an interface, such as a video interface. In addition to the monitor, computers can also include other peripheral output devices such as speakers and printer, which can be connected through an output peripheral interface.

The computer can operate in a networked environment using logical connections to one or more remote computers, such as a remote computer. The remote computer can be a personal computer, a server, a router, a network PC, a peer device or other common network node, and typically includes many or all of the elements described above relative to the computer. The logical connections depicted include a local area network LAN and a wide area network (WAN), but can also include other networks. Such networking environments are commonplace in offices, enterprise-wide computer networks, intranets, and the Internet.

When used in a LAN networking environment, the computer can be connected to the LAN through a network interface or adapter. When used in a WAN networking environment, the computer typically includes a modem or other means for establishing communications over the WAN, such as the Internet. The modem, which can be internal or external, can be connected to the system bus via the user input interface, or other appropriate mechanism. In a networked environment, program modules depicted relative to the computer, or portions thereof, can be stored in the remote memory storage device. By way of example, and not limitation, remote application programs can reside on a memory device. It will be appreciated by a person of ordinary skill in the art that the network connections described herein are exemplary, and other means of establishing a communications link between the computers can be used.

The disclosed embodiments provide systems, methods, and modes for determining ambient audio conditions utilizing a minimum amount of equipment. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

All United States patents and applications, foreign patents, and publications discussed above are hereby incorporated herein by reference in their entireties.

INDUSTRIAL APPLICABILITY

To solve the aforementioned problems, the aspects of the embodiments are directed towards systems, methods, and modes for determining ambient audio conditions utilizing a minimum amount of equipment.

To solve the aforementioned problems, the aspects of the embodiments are directed towards systems, methods, and modes for determining audio calibration specifications of a room utilizing a minimum amount of equipment.

ALTERNATE EMBODIMENTS

Alternate embodiments may be devised without departing from the spirit or the scope of the different aspects of the embodiments.

What is claimed is:

1. A room audio equipment monitoring System (RMS), comprising:
- a speaker;
- a microphone; and
- a digital signal processor (DSP) adapted to
  - generate and transmit a first audio test signal to the speaker, wherein
    - the speaker is adapted to broadcast the first audio test signal into the room, and wherein
    - the first audio test signal comprises a power spectral density (PSD) that is inversely proportional to its frequency, and wherein
      - the broadcast first audio test signal is reflected within the room and generates a reflected first audio test signal, and wherein
    - the microphone is adapted to receive the reflected first audio test signal and output a received first audio test signal, and wherein
  - the DSP is further adapted to
    - process the received first audio test signal,
    - generate and save a frequency-amplitude analysis of the received first audio test signal as an initial reference curve,
    - periodically test the room in a substantially similar manner to generate one or more additional reference curves, and
    - compare the one or more additional reference curves to determine whether they are within a known, predetermined tolerance of the initial reference curve.

2. The RMS according to claim 1, wherein
- the DSP is further adapted to generate a message if the additional reference curve exceeds the known, predetermined tolerance of the initial reference curve.

3. The RMS according to claim 1, wherein the PSD of the first audio test signal is substantially equal per octave of the first audio test signal.

4. The RMS according to claim 1, further comprising:

a remote operating control system (ROCS), wherein the DSP is adapted to respond to commands remotely generated by the ROCS.

5. The RMS according to claim 4, wherein the commands are one or more of a self-automated periodic testing and reporting command, a self-automated non-periodic testing and reporting command, and a remote manually instituted testing and reporting command.

6. The RMS according to claim 1, wherein the DSP is further adapted to determine at which frequencies the initial reference curve deviates in amplitude from the PSD of the subsequently-transmitted audio test signal;

measure deviations in amplitude between the initial reference curve and the PSD of the subsequently transmitted audio test signal; and assign gain coefficients based on the measured deviations in amplitude in regard to respective frequency ranges.

7. The RMS according to claim 1, wherein the DSP is further adapted to compare the initial reference curve of the first audio test signal to a PSD of a subsequently transmitted audio test signal to determine at which frequencies the initial reference curve deviates from the PSD of the subsequently transmitted audio test signal, and generate gain coefficients to apply to a next transmitted audio signal that minimizes deviations between the initial reference curve of the first audio test signal and the PSD of the subsequently transmitted audio test signal.

8. A method for monitoring audio equipment in a room, the method comprising:

generating and transmitting by a digital signal processor (DSP), through a speaker, into a room, a first audio test signal that comprises a power spectral density (PSD) that is inversely proportional to its frequency;

receiving, through a microphone, a reflected portion of the first audio test signal at the DSP;

processing the received reflected portion of the first audio test signal to generate and save a frequency-amplitude analysis of the received reflected portion of the first audio test signal as an initial reference curve;

periodically testing the room in a substantially similar manner to generate one or more additional reference curves; and comparing the one or more additional reference curves to determine whether they are within a known, predetermined tolerance of the initial reference curve.

9. The method according to claim 8, wherein the PSD of the first audio test signal is substantially equal per frequency octave of the audio test signal.

10. The method according to claim 8, further comprising:

generating commands from a remote destination to calibrate the room; and transmitting the commands through a network interface to the DSP.

11. The method according to claim 10, wherein the commands are one or more of a self-automated periodic testing and reporting command, a self-automated non-periodic testing and reporting command, and a remote manually instituted testing and reporting command.

12. The method according to claim 8, further comprising:

comparing the initial reference curve of the first audio test signal to a PSD of a subsequently transmitted audio test signal to determine at which frequencies the initial reference curve deviates from the PSD of the subsequently transmitted audio test signal; and generating and applying gain coefficients to a next transmitted audio signal that minimizes the deviations between the initial reference curve of the first audio test signal and the PSD of the subsequently transmitted audio test signal.

13. The method according to claim 12, wherein the step of generating gain coefficients comprises:

determining at which frequencies the initial reference curve deviates in amplitude from the PSD of the subsequently transmitted audio test signal;

measuring deviations in amplitude between the initial reference curve and the PSD of the subsequently transmitted audio test signal; and assigning gain coefficients based on the measured deviations in amplitude in regard to respective frequency ranges.

* * * * *